US011510833B2

(12) United States Patent
Kirkpatrick

(10) Patent No.: US 11,510,833 B2
(45) Date of Patent: Nov. 29, 2022

(54) HUMAN BODY POSITIONING SYSTEM

(71) Applicant: Taylor C. Kirkpatrick, Denver, CO (US)

(72) Inventor: Taylor C. Kirkpatrick, Denver, CO (US)

( * ) Notice: Subject to any disclaimer, the term of this patent is extended or adjusted under 35 U.S.C. 154(b) by 908 days.

(21) Appl. No.: 16/376,110

(22) Filed: Apr. 5, 2019

(65) Prior Publication Data

US 2019/0307624 A1 Oct. 10, 2019

Related U.S. Application Data

(60) Provisional application No. 62/653,397, filed on Apr. 5, 2018.

(51) Int. Cl.
*A61G 7/10* (2006.01)
*A61G 13/12* (2006.01)

(52) U.S. Cl.
CPC ..... *A61G 7/1017* (2013.01); *A61G 13/126* (2013.01)

(58) Field of Classification Search
CPC ..... A61G 7/10; A61G 7/1017; A61G 13/12; A61G 13/126
See application file for complete search history.

(56) References Cited

U.S. PATENT DOCUMENTS

| | | | | |
|---|---|---|---|---|
| 1,938,006 | A | 12/1933 | Blanchard | |
| 2,636,793 | A | 4/1953 | Meyer | |
| 3,164,382 | A * | 1/1965 | Johnson | A63B 19/04 472/17 |
| 3,584,321 | A | 6/1971 | Buchanan | |
| 4,872,657 | A | 10/1989 | Liisi | |
| 5,759,107 | A * | 6/1998 | Nagel | A63G 31/16 472/60 |
| 5,818,137 | A | 10/1998 | Nichols et al. | |
| 7,395,606 | B2 | 7/2008 | Crampton | |
| 7,524,283 | B1 | 4/2009 | Johnstone, II | |
| 9,072,646 | B2 | 7/2015 | Skripps et al. | |
| 9,198,817 | B2 | 12/2015 | Jackson | |
| 2012/0118296 | A1 | 5/2012 | Oeltjen | |

* cited by examiner

*Primary Examiner* — Fredrick C Conley
(74) *Attorney, Agent, or Firm* — Hall Estill Law Firm

(57) ABSTRACT

A human body positioning system can employ a base that supports a first arm via a first hinge, a second arm connected to the first arm via a second hinge, and a third arm connected to the second arm via a third hinge. A human body may be supported within the third arm by a body support. Each of the arm can be configured with a cutout region positioned to provide physical access to a portion of the human body.

20 Claims, 4 Drawing Sheets

HUMAN BODY POSITIONING SYSTEM

RELATED APPLICATION

The present application makes a claim of domestic priority to U.S. Provisional Patent Application No. 62/653,397 filed Apr. 5, 2018, the contents of which are hereby incorporated by reference.

SUMMARY

A human body positioning system, in accordance with some embodiments, has a base supporting a first arm via a first hinge, a second arm connected to the first arm via a second hinge, and a third arm connected to the second arm via a third hinge. A human body is supported within the third arm by a body support. Each of the arm are configured with a cutout region positioned to provide physical access to a portion of the human body.

Other embodiments of a human body positioning system connect a first arm to a base via a first hinge, connect a second arm to the first arm via a second hinge, and connect a third arm to the second arm via a third hinge. A human body is attached to a body support that positions the human body within the third arm. A portion of the human body is then accessed when cutout regions of each arm are aligned.

In various embodiments, a human body positioning system has at least a base supporting a support member with an arm assembly. A human body is attached to the support member and a curved arm with a first attachment member with the human body and support member each positioned above a ground plane. The curved arm has a cutout region to provide physical access to a portion of the human body.

These and other features which may characterize assorted embodiments can be understood in view of the following detailed discussion and the accompanying drawings.

DETAILED DESCRIPTION

Figure 1:
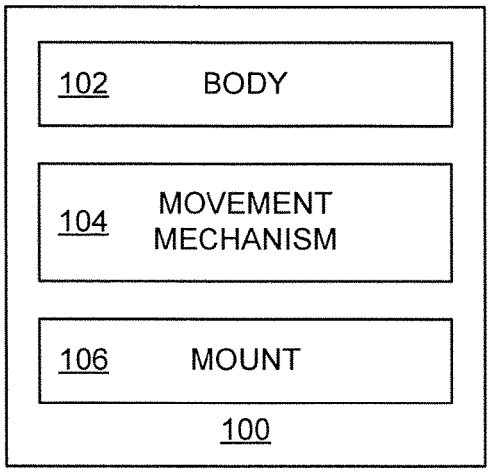
FIG. 1 depicts a block representation of an example Human Body Positioning System in which various embodiments can be practiced.

Without limitation, the various embodiments disclosed herein are generally directed to a Human Body Positioning System that provides optimized physical manipulation of a human subject.

A variety of unmet needs remain to retain and position a human body in space along multiple axes in association with a variety of purposes. In the past, human body retention and positioning involved stationary beds and tables, mechanized beds, and retention straps. A common challenge associated with known apparatuses and techniques for human body retention and positioning relates to the decrease in access to a significant part of the human body due to the bulk of mass required to support the human body. For instance, stationary beds and tables, can create an impediment to access below and superior to, inferior to, and lateral to the human body. Such physical impediment stems from the requirement to distribute the weight of the human body upon the surface of the underlying bed or table, which generally extends superior to, inferior to, and lateral to the human body during typical use.

Mechanized beds, and other solutions, that alter the weight distribution of a supported human body by repositioning the appendages of the human body are plagued by surfaces that extend superior to, inferior to and lateral to the human body creating an obstruction to access to the human body during normal use. It is noted that retention straps, and associated supports, in addition to creating obstructions to access to the human body during normal use, also can hold the human body in such a manner that makes dynamically repositioning the body difficult for a variety of intended uses. These and associated challenges pose problems in a variety of contexts which require adequate retention and dynamic repositioning of a human body during activities that require outside access to the human body by another person or object.

Surgeons have difficulty accessing different areas of the body during complex surgical procedures. This is especially so in surgical procedures requiring the repositioning of a patient during the procedure. The traditional use of a surgical table during surgical procedures succeeds at immobilizing and supporting a human body during the procedure, but also presents several drawbacks. First, patients may experience point load damage to their body, which can lead to bruising, circulation issues and/or other maladies. Moreover, many surgical procedures require the rotation of patients between phases of a surgical procedure.

During a spinal fusion procedure, for instance, a surgeon may need to position the patient on her back to access the patient from the anterior approach, and then subsequently rotate the patient onto her side or stomach for the placement of pedicle screws via a posterior approach. Such a scenario often requires two or more people to lift and/or roll the patient during repositioning. In cases where an open or freshly sutured wound exists from the surgical approach, significant post-surgical damage can be inflicted on the patient. Hence, there exists an unmet need to create an improvement over the presently dominantly utilized paradigm of utilizing a surgical table during surgeries that require the repositioning of the patient.

Separately, many people have difficulty participating in sexual activities requiring positioning without use of upper body or lower body muscles for support. The sexual interaction of multiple persons often requires strenuous or unnatural positioning of the body in supported positions. In cases where one or more of the persons have physical difficulty, for instance, self-support in such positions during sexual activity may pose serious challenges. Especially in those situations, but also in other contexts, standing, kneeling or other sustained access to portions of the human body can be limited by gravitational forces and muscular limitations. Persons with physical disabilities, for instance, may be incapable of holding themselves in sexual positions for sustained periods of time, and such activity may present risk of danger or extreme fatigue. These pose unmet needs for the ability to sustain and reposition a human body via a supportive device for use in association with sexual activity.

In other contexts, personal enjoyment may be derived from new methods of access to a human body during sexual activity, requiring a solution to a heretofore unmet need to suspend a person in a variety of positions rotated around multiple axes. A need therefore remains to immobilize a human body in a variety of suspended positions to enable or improve sexual activity.

Accordingly, various embodiments are directed to a system for manipulating the physical position of a human subject with optimized efficiency and safety. FIG. 1 illustrates a block representation of an example Human Body Positioning System 100 in which assorted embodiments may be practiced. The System 100 can incorporate one or more human bodies 102 into a controlled position relative to a moving mechanism 104 via one or more mounts 106. It is contemplated that the attachment of a human body 102 to the movement mechanism 104 occurs with manual, automatic, or assisted manipulation of at least one mount 106. That is, a user of the System 100 can attach to the movement mechanism 104 alone or with the assistance of a second user by activating, or otherwise employing, one or more mounts 106.

Figure 2:
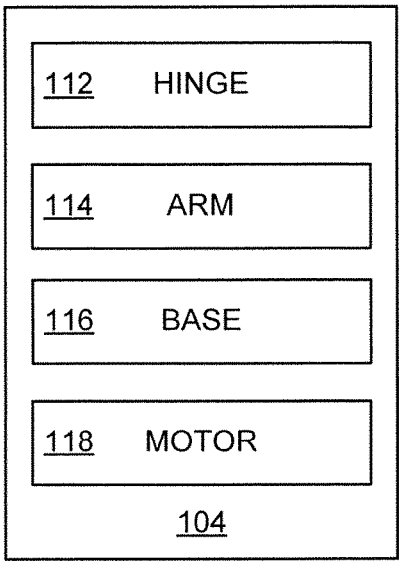
FIG. 2 depicts a block representation of an example movement mechanism capable of being implemented into the System of FIG. 1 in some embodiments.

FIG. 2 displays a block representation of an example movement mechanism 104 that can be employed in the Human Body Positioning System 100 in accordance with various embodiments. One or more hinges 112 can be utilized to provide a moving connection between at least two separate arms 114. The hinges 112 are not limited to a particular movement plane, orientation, or physical configuration. Hence, a hinge 112 can be arranged to provide swivel arm movement in multiple different planes or restricted to a single plane of motion. In some embodiments, at least one hinge 112 is configured to restrict motion of at least one arm 114 to less than 360° of motion in a single plane while other embodiments allow 360° of motion in a single plane.

The movement mechanism 106 can be anchored by one or more bases 116 that provide stable support for the arm(s) 114 to move without inadvertently wobbling, or otherwise moving, the attached body/bodies 102. A base 116 is not limited to a particular size, position, or construction, but in some embodiments is a solid piece of material or an assembly of multiple pieces that secure the arm(s) 114 in place relative to an underlying ground plane until articulated by one or more users. The movement mechanism 106 can be utilized manually by physically moving one or more arms 114 either directly via contact with an arm 114 or indirectly via contact with the attached body 102.

A body 102 can be articulate and otherwise moved with the assistance of one or more motors 118 that convert electrical signals to mechanical motion of at least one arm 114 and/or a mount 106 connected to a body 102. A motor 118 may be activated, and otherwise controlled, via automated instructions, such as a predetermined choreographed routine, or via manual instructions, such as with a remote or through voice activation. It is contemplated that a motor 118 can automatically activate in response to manual articulation of an arm 114, or body 102, to provide assistance, but not complete power, to allow a user to precisely control the speed and range of motion of the arm 114 and body 102. Such motorized assist allows a System 100 to accommodate bodies 102 with a wide range of physical traits, such as weight, height, and center of gravity.

Figure 3:
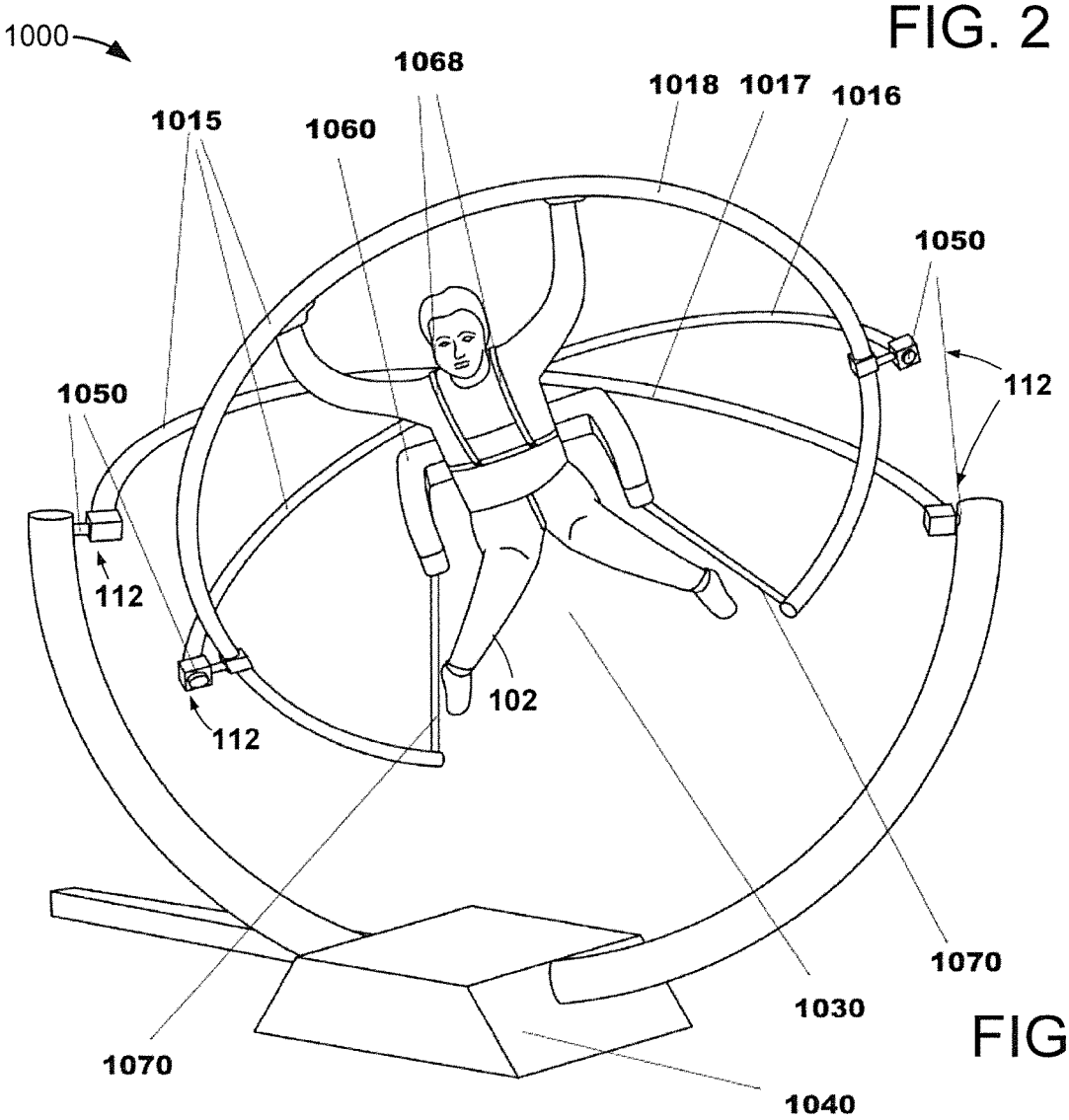
FIG. 3 depicts portions of an example Human Body Positioning System configured and operated in accordance with assorted embodiments.

FIG. 3 depicts an example Human Body Positioning System 1000 configured in accordance with some embodiments. The System 1000 employs a plurality of arms 1015 that can independently, and collectively, move to displace a body 102. Although not required or limiting, the embodiment shown in FIG. 3 has concentric arms 1016/1017/1018 that each have a cutout 1030 region that provides external access to the body 102. The respective arms 1015 are stabilized by a base 1040 and are connected with a plurality of separate joints 1050 that can comprise one or more hinges 112 to provide controlled motion throughout a predetermined range of atm 1015, and body 102, motion.

The respective arms 1015 can be configured to be continuously curvilinear, but may alternatively have linear sections, or be continuously linear. In an embodiment, the respective arms 1015 are connected to each other at one or more points. In various embodiments, an arm 1015 has a shape and size the forms an incomplete circle or oval. In other embodiments, each of the one or more arms 1015 incorporate at least one cutout 1030 region that provides a discontinuous ring. The cutout 1030 provides an access opening for at least a second person to access the human body 102 supported by the System 1000 in an unobstructed fashion.

The System 1000 can be configured so that the respective arms 1015 are positioned such that the cutouts 1030 align to create an unobstructed pathway for at least one other person or object to have direct access to the human body 102 suspended by the System 1000. It is recognized that by creating a discontinuity in the arms 1015, where the arms 1015 would otherwise resemble a full circular or ovular shape, a direct access pathway may be created to the suspended human body 102 during multiple different intended methods of use. In the non-limiting embodiment of FIG. 3, the System 1000 comprises three independently movable arms 1015 positioned concentrically, such that the outermost arm 1016 is connected to the base 1040 by two joints 1050, a middle arm 1017 links to the outermost arm 1016 via one joint 1050 positioned posterior to the body 102, and an innermost arm 1018 links to the middle arm 1017 via two joints 1050.

It is contemplated that each of the arm 1015 is constructed primarily of stainless steel, but such construction is not limiting as any material can be used that provides ample rigidity and strength to support the attached body 102 in a suspended position separated from a ground plane, as shown in FIG. 3. In a non-limiting configuration, the outermost arm 1016 has a radius of approximately 6 feet 6 inches, the middle arm 1017 has a radius of approximately 6 feet, and the innermost arm 1018 has a radius of approximately 5 feet 6 inches. The reduced size, but matching overall shape, of the respective arms 1015 allows for efficient movement of the body 102 by manual, or automatic, manipulation of one or more arms 1015.

Some embodiments of the System 1000 incorporate a multiplicity of joints 1050 having matching constructions and configurations while other embodiments employ joints 1050 with different constructions. This way, the movement of different arms 1015 can be arranged with different physical characteristics, such as range of motion, friction, and minimum force to induce movement. In the variety of embodiments, each of the joints 1050 is of a character and strength to support and facilitate the rotation of a mass of weight comprising a human body 102 of any size and the bulk of the material of the respective anus 1015, such as stainless steel, fiberglass, plastic, polymer, or ceramic.

Figure 4A:
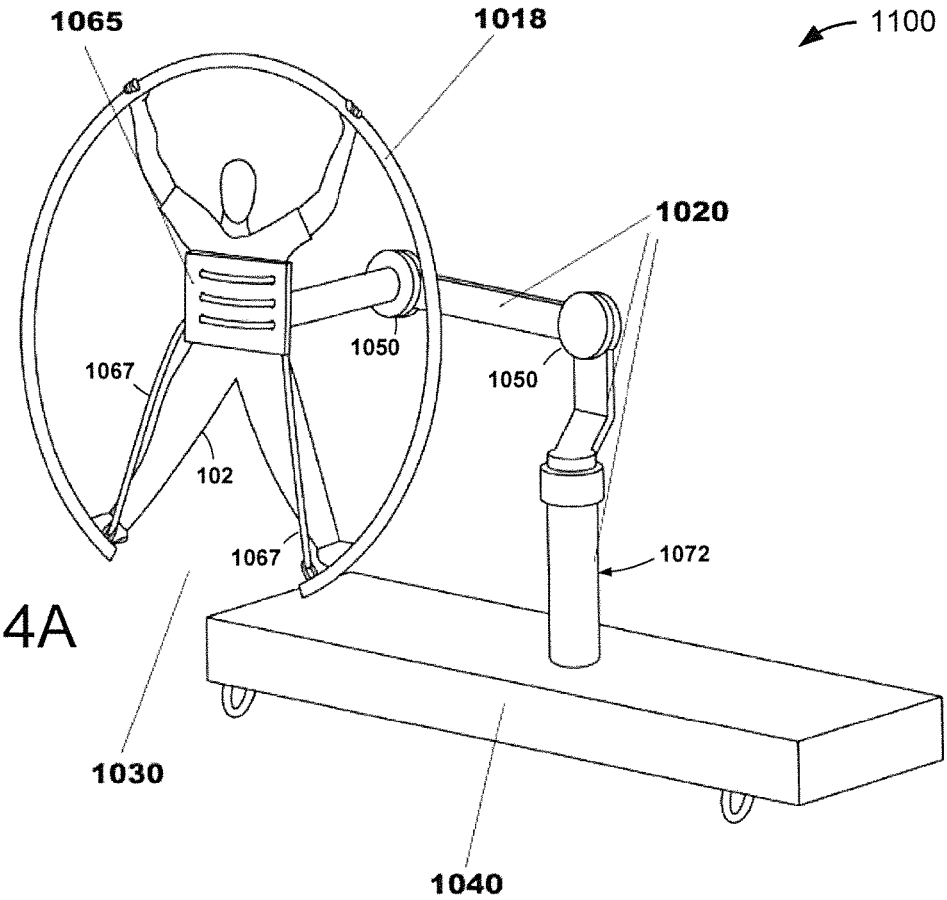
FIGS. 4A-4C respectively depict portions of an example Human Body Positioning System arranged in accordance with various embodiments.
Figure 4B:
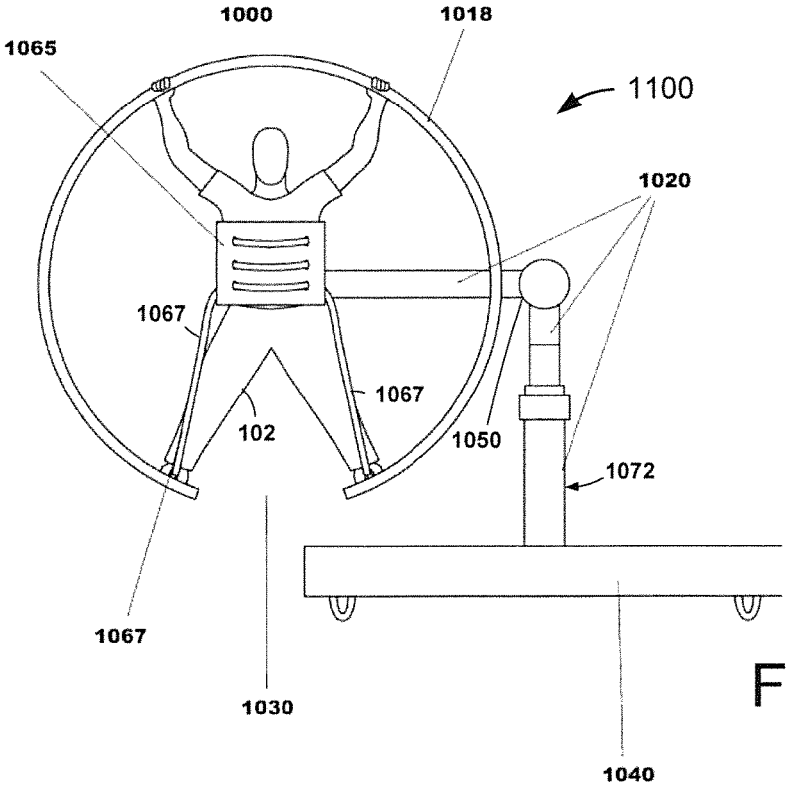
Figure 4C:
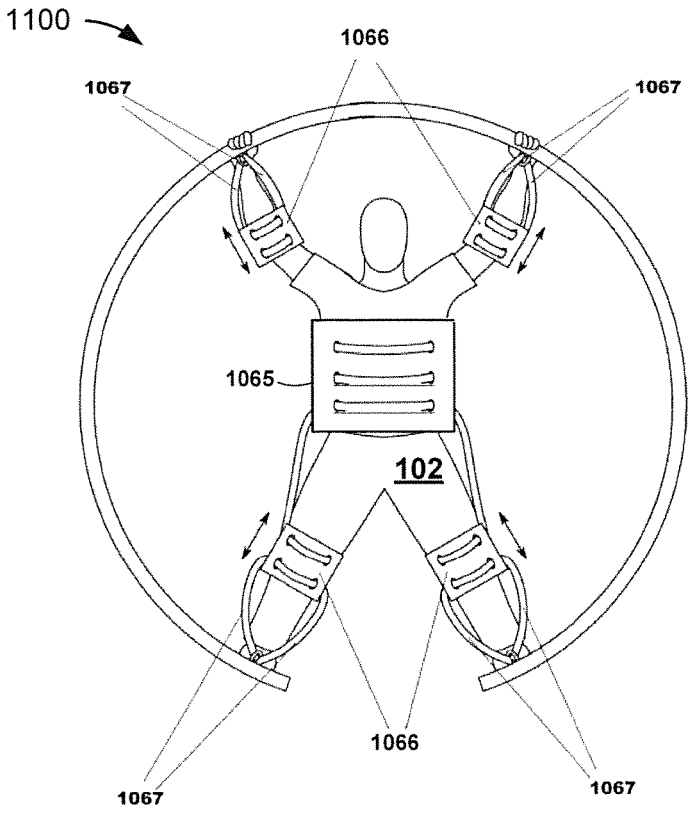
Figure 5:
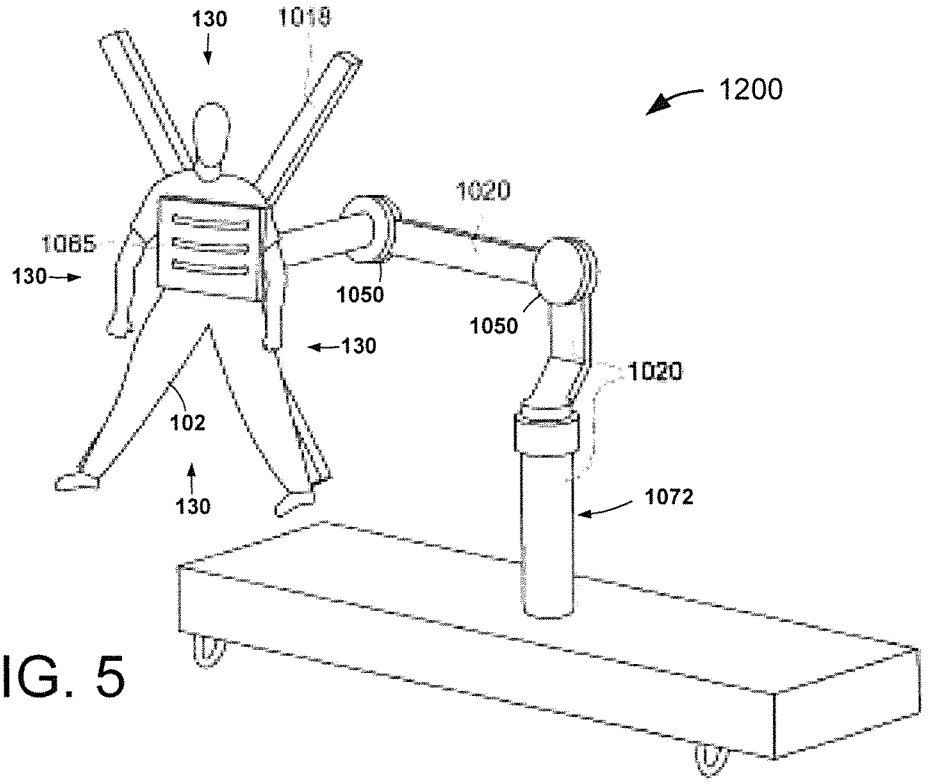
FIG. 5 depicts portions of an example data storage system utilized in accordance with some embodiments.

It is contemplated that a joint 1050 consists of a swivel ball configuration, but such arrangement is not required as a joint 1050 may consist of a rotary union style configuration. In other words, the joints 1050 can be configured to provide a variety of different body 102 movement characteristics, such as resolution, dexterity, and stability. In an alternative embodiment, the innermost arm 1018 is not connected to any other curved arms, but rather connected to the arm assembly 1020 comprising three or more substantially linear support arms, as depicted in FIGS. 4A-5.

As shown in FIG. 3, a C-shaped support 1060 connects to the innermost arm 1018 via two support bars 1070. The C-shaped support 1060 can be constructed of a rigid material, such as steel, ceramic, plastic, or other metal that has a character and strength to hold a human body 102 in place. The C-shaped support 1060 may be configured to accommodate padding and/or other soft material to insulate the impact of the rigid components of the support 1060 from the human body 102 contained within during a variety of intended uses.

Although not required or limiting, the C-shaped support 1060 can have a structure with bulk designed to partially enclose or surround the human body 102 and support straps 1068 designed to hold the torso of the human body 102 within the System 1000. Any number of support straps 1068 can be employed to connect to the C-shaped support 1060 by wrapping around the C-shaped support 1060 and tightening. In varying embodiments of the invention, the support straps 1068 partially, or completely, comprise two-inch seatbelt webbing, chains, rope, or tube that may, or may not, be connected by one or more buckles, or other tightening mechanism to hold and support the torso of a human body 102 in a stationary position.

The support straps 1068 may, in some embodiments, be arranged as a jet-fighter pilot seatbelt. One or more hook-and-loop attachment means may also be incorporated into the system 1000 to connect embodiments of support webbing or straps weaved around pulleys or buckles to enable tightening of the human body 102 in place. It is noted that the support straps 1068 may comprise the only mechanism external to the body 102 used to secure the human body 102 within the System 1000.

The C-shaped support 1060 may resemble a discontinuous or continuous structure of a variety of alternative shapes and configurations (other than the shape of a "C") to contain and/or affix the human body 102 to the System 1000. In a non-limiting alternative embodiment, instead of a C-shaped support 1060, one or more substantially planar supports may be used, optionally containing holes for the threading of attachment members, such as a rope, chain, or elastic tube.

The containment of the body 102 within multiple independent arms 1015 allows for articulation in any plane and into an infinite number of body positions. However, the numerous arms 1015 can take up a relatively large volume of space that may not be conducive to some environments, such as a residence, apartment, or operating room. FIGS. 4A-4C display assorted views of an example human body positioning system 1100 that can be utilized, in accordance with various embodiments, to selectively articulate a body 102 in a variety of different positions within different planes, orientations, and directions.

In FIG. 4A, a perspective view of the system 1100 conveys how a body mount 106 can comprise a planar support member 1065 connected to the body 102 and to a single curved atm 1018 via one or more attachment members 1067. The curved arm 1018 is supported by an arm assembly 1020 that extends from a mobile base 1040. The arm assembly 1020 connects directly to the planar support member 1065, instead of to the curved arm 1018, to allow relatively precise body 102 articulation via manipulation of the respective joints 1050. In some embodiments, the planar support 1065 is made of a soft, yet durable, material, such as leather, nylon, rubber, synthetic, or combination thereof.

It is contemplated that the arm assembly 1020 consists of one or more telescoping members 1072 that allow the body 102 to have a variable elevation relative to the base 1040. With the configuration shown in FIGS. 4A and 4B, an arm assembly 1020 joint 1050 is positioned directly posterior to the intended position of the human body 102 during various intended uses of the system 1100. The alternative mounting configuration shown in FIG. 4C illustrates how the centralized planar support member 1065 can be complemented by appendage support members 1066 that are separately attached to the appendages of the body 102. The various appendage support members 1066 can be configured as planar, or curvilinear objects, that partially, or completely, surround the appendage.

The respective appendage support members 1066 can be independently, or collectively, attached to the curved arm 1018 via one or more flexible attachment member 1067. It is contemplated that an attachment member 1067 interacts with a body appendage to restrict movement and support portions of the body 102 without inducing pain. By weaving the attachment member 1067 through an appendage support member 1066, as shown, the amount of pressure experienced by the body 102, range of appendage movement, and amount of force needed from the user gripping the arm 1018 can be customized.

Assorted embodiments attach each of the respective appendage support members 1066 the innermost arm 1018 in such a way that the appendages of the human body 102 enclosed are spread apart during a variety of the intended System 1200 uses. In some embodiments, the appendage support members 1066 affix to an arm 1018 via a rigid connection, such as a weld, fastener, or magnets designed to hold a human appendage. Alternative embodiments incorporate external appendage connections, such as a handcuff, legcuff, hook-and-loop strap, or combination thereof, to link to the innermost arm 1018. Such alternative appendage connection can replace, or supplement, the flexible attachment member 1067, which may be tightened to a desired support configuration. It is contemplated that the respective appendage support members 1066 are independently removable and reattachable to the System 1200 by way of, for example, tightening and locking buckles.

FIG. 5 depicts portions of another example human body positioning system 1200 that can be utilized to articulate a human body 102 in accordance with various embodiments. The system 1200 replaces singular curved arms 1015/1018 with physically separated anus 1018 that can be arranged as curvilinear, linear, or combinations thereof, protrusions that allow for selective attachment of body appendages. For appendage attachment, one or more arms 1018 can be used for support via at least one attachment member. It is contemplated an attachment member may be flexible or rigid and may be separate from, or integrated into, the arm 1018 itself.

Figure 6:
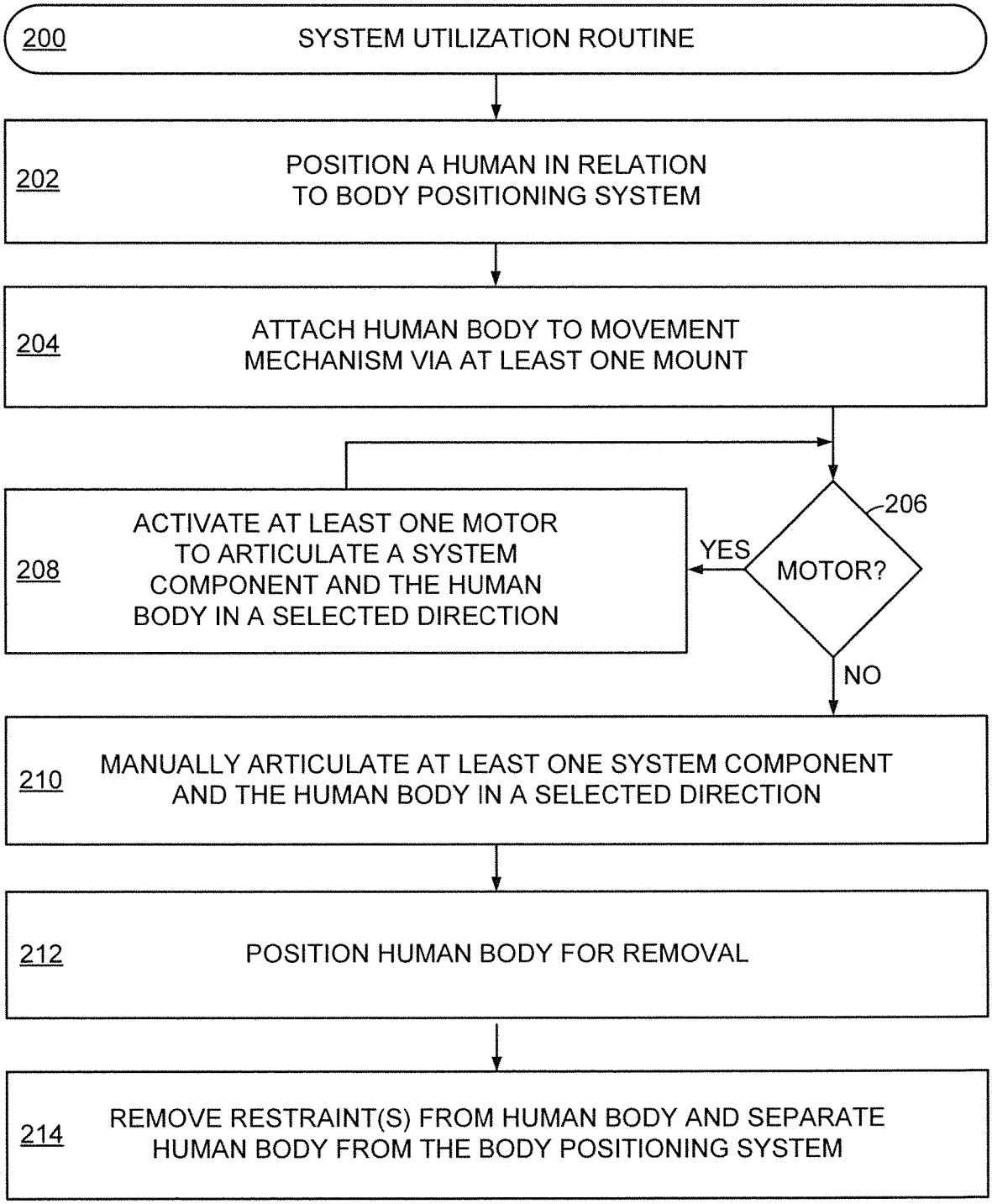
FIG. 6 is an example system utilization routine that can be carried out with the respective embodiments of FIGS. 1-5.

FIG. 6 is a flowchart of an example human body positioning system utilization routine 200 that can be carried out with the various embodiments of FIGS. 1-5. Initially, step 202 positions at least one human body in relation to a body positioning system. Step 204 then attaches the human body to at least one mount of a movement mechanism with one or more attachment member. It is contemplated that step 204 utilizes a torso-positioned support member with, or without, a plurality of appendage support members. As a result, the human body will be fully supported by the system and have a limited range of movement.

Decision 206 evaluates if a motorized source is to be employed to move the human body. If so, step 208 activates at least one motor to articulate a system component, such as an arm, arm assembly, or support member, in a selected direction. It is noted that step 208 can correspond with additional manual manipulation of a system component, which may or may not be the same component being articulated via a motor. Any number of separate motors can be utilized cyclically by revisiting decision 206 and step 208 in order to position the human body in a desired orientation.

At the conclusion of motorized movement, step 210 employs manual articulation of at least one system component by the supported human body, or by an external second user, to alter the orientation and/or position of the supported human body. Step 210 may be executed any number of times to effect different human body positions, as desired by the human body, or by the external second user. Once human body support is no longer desired, step 212 positions the human body for removal from the system, such as in close proximity to the ground, with the feet of the body facing the floor, and/or aligning the cutouts of the respective system arms to facilitate an exit from the system.

Next, step 214 removes the restraint(s), otherwise characterized as attachment members and/or support members, from the human body to allow the body to be separated from the body positioning system. The ability to selectively articulate a human body with, or without, motorized assistance provides controlled support that facilitates efficient access to the human body, regardless of body position. Accordingly, assorted activities involving human body access are optimized.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued. Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The terms "coupled" and "linked" as used herein is defined as connected, although not necessarily directly and not necessarily mechanically. A device or structure that is "configured" in a certain way is configured in at least that way, but may also be configured in ways that are not listed. Also, the sequence of steps in a flow diagram or elements in the claims, even when preceded by a letter does not imply or require that sequence.

What is claimed is:

1. An apparatus comprising:

a base supporting a first arm via a first hinge;

a second arm connected to the first arm via a second hinge;

a third arm connected to the second arm via a third hinge; and a body support attached to the third arm and supporting a human body, each arm configured as an incomplete circle defining a cutout region positioned to provide unobstructed physical access to a portion of the human body.

2. The apparatus of claim 1, wherein the first arm, second arm, and third arm are concentric circles.

3. The apparatus of claim 1, wherein the first arm, second arm, and third arm have matching shapes and different respective sizes.

4. The apparatus of claim 1, wherein the base comprises a first support arm and a separate second support arm, the first hinge attached to the first support arm.

5. The apparatus of claim 4, wherein a fourth hinge is attached to the second support arm, the fourth hinge connected to the second arm.

6. The apparatus of claim 1, wherein the second arm is connected to the third arm via the third hinge and a fifth hinge.

7. The apparatus of claim 1, wherein each hinge is a swivel ball joint.

8. The apparatus of claim 1, wherein the human body is completely supported above a ground plane by the base.

9. The apparatus of claim 1, wherein the base is mobile.

10. A method comprising:

connecting a first arm to a base via a first hinge;

connecting a second arm to the first arm via a second hinge;

connecting a third arm to the second arm via a third hinge;

supporting a human body attached to a body support positioned within the third arm; and accessing a portion of the human body aligned with a cutout region of each arm, each cutout region defined by a discontinuous portion of the respective arms.

11. The method of claim 10, wherein the cutout region of each arm is aligned to provide physical access to the portion of the human body.

12. The method of claim 10, further comprising moving the human body by articulating at least one arm.

13. The method of claim 10, further comprising moving the human body by activating at least one motor.

14. The method of claim 12, wherein the human body is moved to a plurality of different positions without physically contacting a ground plane.

15. A system comprising:

a base supporting a support member with an arm assembly;

a human body attached to the support member and a curved arm with a first attachment member, the human body and support member each positioned above a ground plane, the curved arm configured as a discontinuous ring defining a cutout region to provide unobstructed physical access to a portion of the human body.

16. The system of claim 15, wherein the arm assembly comprises a telescoping member.

17. The system of claim 15, wherein the arm assembly comprises multiple hinges.

18. The system of claim 15, wherein the arm assembly is connected posterior to the human body.

19. The system of claim 15, wherein the human body is attached to the curved arm via at least one appendage support member and a second attachment member.

20. The system of claim 15, wherein the arm assembly is connected to a motor configured to provide automated articulation of the human body.

* * * * *